US005373833A

United States Patent [19]

D'Andrade

[11] Patent Number: 5,373,833

[45] Date of Patent: Dec. 20, 1994

[54] PROJECTILE SHOOTING AIR GUN WITH BLADDER

[76] Inventor: Bruce M. D'Andrade, 3 Ten Eyck Rd., Whitehouse Station, N.J. 08889

[21] Appl. No.: 89,837

[22] Filed: Jul. 12, 1993

[51] Int. Cl.[5] ..... F41B 11/26

[52] U.S. Cl. ..... 124/69; 124/73

[58] Field of Search ..... 124/56, 59, 69–74, 124/76, 83

[56] References Cited

U.S. PATENT DOCUMENTS

| | | | |
|---|---|---|---|
| 1,026,303 | 5/1912 | Dickey | 124/69 |
| 1,214,398 | 1/1917 | Welch | 124/69 |
| 1,309,321 | 7/1919 | Fairweather | 124/69 |
| 1,404,689 | 1/1922 | Fairweather | 124/69 |
| 1,488,995 | 4/1924 | McCollom . | |
| 1,575,644 | 3/1926 | Schmidt . | |
| 1,818,810 | 8/1931 | Miller | 124/69 |
| 2,011,749 | 8/1935 | Brading . | |
| 2,237,678 | 4/1941 | Lohr et al. . | |
| 2,733,699 | 2/1956 | Krinsky | 124/69 |
| 2,784,712 | 3/1957 | Cassidy | 124/69 |
| 2,818,056 | 12/1957 | Martin . | |
| 4,159,705 | 7/1979 | Jacoby | 124/70 X |
| 4,223,472 | 9/1980 | Fekete et al. | 124/70 X |
| 4,732,136 | 3/1988 | Ferri . | |
| 4,735,239 | 4/1988 | Salmon et al. . | |
| 4,848,307 | 7/1989 | Tsao | 124/59 |
| 4,854,480 | 8/1989 | Shindo . | |
| 4,892,081 | 1/1990 | Moormann . | |
| 5,242,323 | 9/1993 | Rappaport | 124/66 X |

*Primary Examiner*—Randolph A. Reese
*Assistant Examiner*—John A. Ricci
*Attorney, Agent, or Firm*—Kenneth P. Glynn

[57] ABSTRACT

The present invention is a projectile-shooting air gun. It includes a main housing having a barrel adapted for receiving a projectile, a handle and a trigger, as well as a high pressure, inflatable bladder connected to the main housing, the bladder having an inlet and an outlet. There is also a pressurizing mechanism for providing air pressure to the bladder to inflate it. The pressurizing mechanism is physically connected to the housing and functionally connected to the bladder inlet. There is a bladder deflation valve having an upstream side and a downstream side, and it is connected to the bladder outlet at the valve's upstream side, and is connected to the trigger for opening and closing thereof, and is connected to a projectile launch tube at the valve's downstream side for launching a projectile upon deflation of at least a portion of the bladder when it has been inflated. The launch tube is located in the barrel of the main housing and connected to the downstream side of the bladder deflation valve, and adapted for receiving and shooting a projectile. In preferred embodiments, the bladder has a predetermined expansion size to which it is capable of being inflated, and an enclosure is provided around the bladder, which is a size less than the predetermined expansion size to enhance a controlled pressurization of the bladder during inflation and deflation.

19 Claims, 2 Drawing Sheets

PROJECTILE SHOOTING AIR GUN WITH BLADDER

BACKGROUND OF THE INVENTION

1. Field of the Invention

The present invention is directed to air pressurized toy guns for launching projectiles. More specifically, the toy air gun of the present invention relies upon a pressurizable bladder for release of air pressure to shoot the projectile, e.g. a soft dart.

2. Information Disclosure Statement

Air guns have been available for decades and typically rely upon a reciprocal hand pump to compress air in a chamber for subsequent firing. These are often used for firing BB's or pellets. Other gas powered guns rely upon canisters of compressed gas wherein the gas is released for firing. Toy guns which involve the use of bladders have been developed for storing and shooting water.

The following patents are representative of toy guns, illustrating in chronological order toy guns which shoot projectiles or utilize bladders:

U.S. Pat. No. 1,488,995 issued to Edwin McCollom describes a projectile shooting toy gun which relies upon a spring loaded, u-shaped rod which is cocked by pulling and released by a trigger release.

U.S. Pat. No. 2,011,749 to Harry Brading describes a dart game which uses a blow pipe for launching the darts.

U.S. Pat. No. 1,575,644 to William Schmidt describes a pistol which fires a projectile and relies upon a compression spring to compress air and to thereby actuate the firing of the projectile.

U.S. Pat. No. 2,237,678 issued to Raymond Lohr et al describes a repeating, cork shooting toy which utilizes a cork magazine which rotates after each firing to position the next cork in sequence for firing.

U.S. Pat. No. 2,818,056 to Robert Martin describes a compressed gas-operated propelling mechanism in a toy gun.

U.S. Pat. No. 4,732,136 issued to Giampiero Ferri sets forth a toy gun which relies upon spring based compression to a launch a plastic bullet or the like.

U.S. Pat. No. 4,735,239 issued to Michael Salmon et al describes a liquid projecting device which is basically a bladder and a release trigger, the bladder being expanded by being filled up with water. Likewise, U.S. Pat. No. 4,854,480 issue to Robert Shindo describes a water gun with an expandable rubber tube or bladder which is filled with water and subsequently released by the trigger mechanism.

U.S. Pat. No. 4,892,081 Randall Morrmann sets forth a compressable ball launcher which relies upon a telescoping cylindrical gun to compress air to force a ball out of a nozzle.

Notwithstanding the foregoing, the prior art neither teaches nor suggests the use of a pressurized bladder, pumped up by a pump on a toy gun, to release pressure for shooting a projectile, as in the present invention.

SUMMARY OF THE INVENTION

The present invention is a projectile-shooting air gun. It includes a main housing having a barrel adapted for receiving a projectile, a handle and a trigger, as well as a high pressure, inflatable bladder connected to the main housing, the bladder having an inlet and an outlet. There is also a pressurizing mechanism for providing air pressure to the bladder to inflate it. The pressurizing mechanism is physically connected to the housing and functionally connected to the bladder inlet. There is a bladder deflation valve having an upstream side and a downstream side, and it is connected to the bladder outlet at the valve's upstream side, and is connected to the trigger for opening and closing thereof, and is connected to a projectile launch tube at the valve's downstream side for launching a projectile upon deflation of at least a portion of the bladder when it has been inflated. The launch tube is located in the barrel of the main housing and connected to the downstream side of the bladder deflation valve, and adapted for receiving and shooting a projectile. In preferred embodiments, the bladder has a predetermined expansion size to which it is capable of being inflated, and an enclosure is provided around the bladder, which is a size less than the predetermined expansion size to enhance a controlled pressurization of the bladder during inflation and deflation.

BRIEF DESCRIPTION OF THE DRAWINGS

The present invention is more fully understood when the present specification is taken in conjunction with the drawings appended hereto, wherein.

DETAILED DESCRIPTION OF THE PRESENT INVENTION

The present invention toy air gun has been developed to provide high powered, safe shooting of projectiles, such as foam darts, while being fully self-contained, i.e. without the need for pressurized gas canisters. The toy air gun of the present invention is also capable of relatively constant releases of pressurized air to exhibit repeated, consistent firings. It relies upon manual pumping to inflate a bladder which will store pressurized air for subsequent firing.

Figure 1:
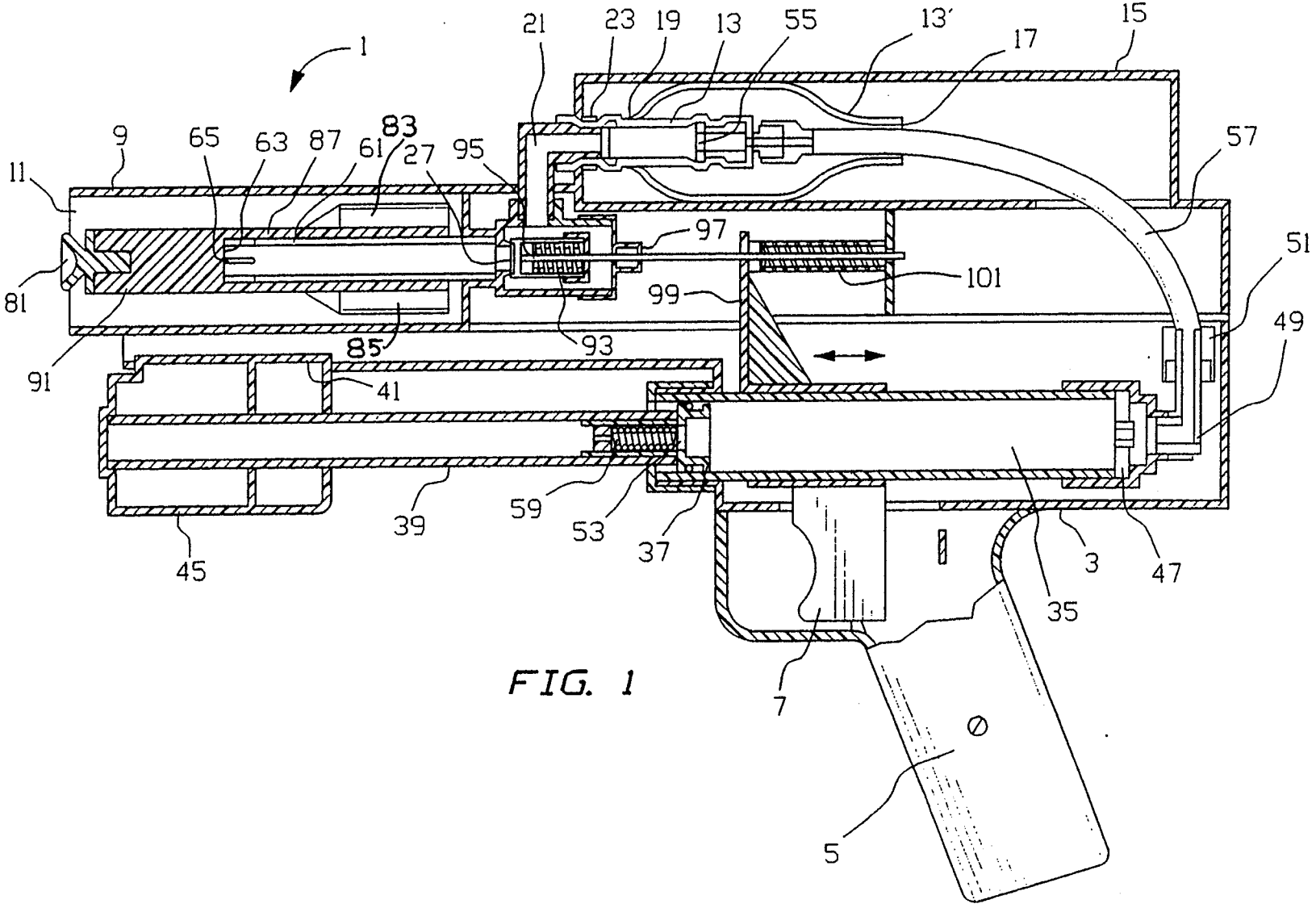
FIG. 1 shows a side cut view of a present invention toy air gun.
Figure 2:
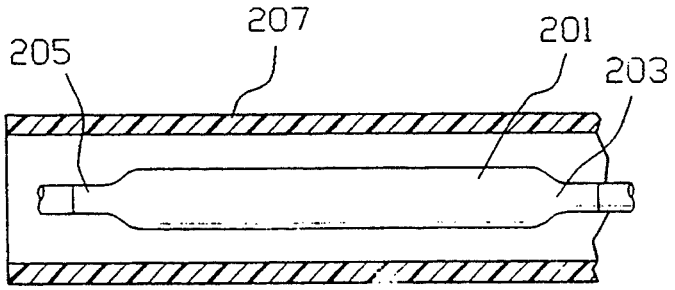
FIGS. 2 through 5 show a partial side view of an enclosure and bladder for a present invention toy air gun wherein the bladder is shown in various inflation/-deflation stages.

Referring now to FIG. 1, the operation of the present invention embodiment can best be explained. FIG. 1 is a side view of the present invention embodiment toy air gun 1 with main housing 3, handle 5, trigger 7 and barrel 9 with opening 11.

Bladder 13 is located within enclosure 15. Bladder 13 has inlet 17 and outlet 19 and is cylindrical, but could be of another shape and not exceed the scope of the present invention. Outlet 19 has outlet tube 21 connected thereto via ring 23. This outlet tube 21 is connected to bladder deflation valve 27, discussed below.

Toy air gun 1 is operated by pressurizing the bladder 13 with air. (Inflated bladder 13' illustrates the bladder after pressurization.) Air is forced into the bladder 13 by the relative movement of the piston 37 within the air pump shaft 35. The piston 37 is operated by the pump rod 39 that connects the piston 37 to the slider handle 45. The pump rod 39 is anchored to the slider handle 45 via formed connector 41. The slider handle 45 is operated manually by the user. The user holds the slider handle 45 with one hand and the gun handle 5 with the other. The slider handle 45 is then moved back and forth along the length of the barrel 9. The back and forth action is transferred to the piston 37, which forces air past a one way flow valve 47, through a length of air flow tubing 49, through a connector 51, tubing 57 and into the bladder 13. Air is continuously added to the bladder 13 via inlet 55 until a desired pressure is reached.

Once under pressure, the air in bladder 13 is prevented from flowing freely through the outlet tubing 21 by valve 27. Safety release valve 53, with spring 59, prevents over pressurization. The strength of spring 59 in its biased configuration is calibrated, so that when the pressure of air within the gun reaches a predetermined maximum valve, the spring 59 will allow the valve 53 to be released until safe pressure is maintained.

Projectile 91, in this case a soft foam dart with fins, has a suction cup 81, fins 83 and 85 and hollow area 87 adapted to fit over launch tube 61. Note that tube 61 has an outlet 63 at its forward end and a slit 65 on its side. The slit 65 is an optional safety feature. If, for example, a user placed a movable or hard, non-shape conforming object in barrel 9, slit 65 would permit release of air pressure out the side of launch tube 61 thereby reducing pressure coming out of outlet 63 and thus reducing speed and impact of the foreign object, if fired.

Referring now back to bladder deflation valve 27, it has a first, closed position as shown. This is caused by the bias to that position from spring 93. Valve rod 95 is connected to valve 27 and valve housing 97, and is also connected to trigger riser 99. Spring 101 maintains riser 99 to the left, which also keeps valve 27 closed. When the bladder 13 has been pressurized and a projectile such as projectile 91 is loaded, a user pulls trigger 7. This moves riser 99 to the right to overcome springs 93 and 101, opens bladder deflation valve 27, provides a blast of pressure down launch tube 61 and projectile 91 is fired.

FIGS. 2 through 5 show side, partially cut, simplified views of a present invention toy air gun bladder 201 in various states of pressure. There is a preferred embodiment arrangement, as the bladder has a predetermined inflated size and enclosure 207 has a size less than that predetermined inflated size.

Figure 3:
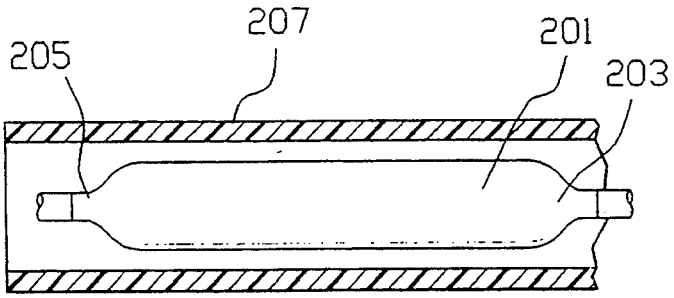
Figure 4:
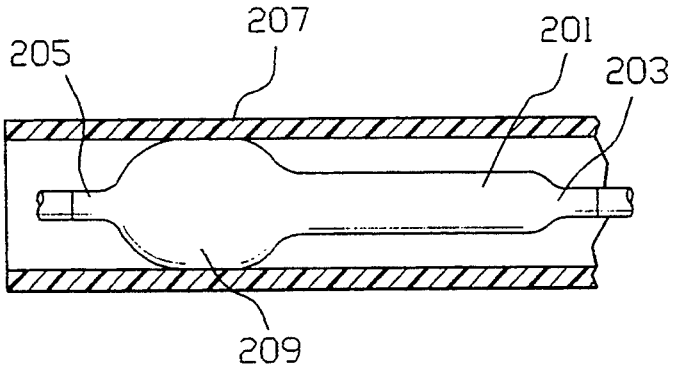
Figure 5:
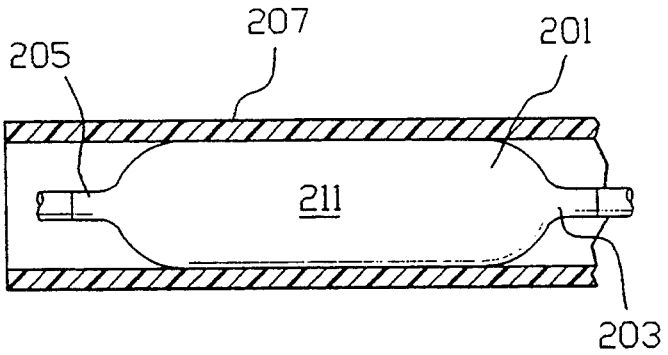

For example, bladder 201 with inlet end 203 and outlet end 205 may be cylindrical and of a specific length. Its uninflated diameter may be one inch and fully inflated with 25 psig, it may have a four inch diameter and thus a size or volume accordingly to its length. Enclosure 207 will have a diameter of, for example, three and one half inches. This causes inflation and deflation to occur with a significant part of the inflation or deflation at a fixed pressure. Thus, in FIG. 2, bladder 201 is at 0 psig. In FIG. 3, there is a pressure needed to cause initial expansion, here 20 psig. Once initial expansion, i.e., actual inflation, has begun as in FIG. 4, the pressure will be lower, i.e. 15 psig. (This is much like blowing up a balloon, where initially greater force is needed to start to stretch the balloon and then inflation takes less pressure.) As more air is added, the bladder 201 will expand down the enclosure at the fixed pressure of 15 psig, as shown in FIG. 5. Like wise, deflation will occur in reverse but at the constant pressure of 15 psig.

It should now be recognized that preferred embodiments toy air guns of the present invention having the enclosure about the bladder, will allow for repeat shots with the same burst of air and thus consistency in firing, until the bladder is substantially fully deflated.

Obviously, numerous modifications and variations of the present invention are possible in light of the above teachings. It is therefore understood that within the scope of the appended claims, the invention may be practiced otherwise than as specifically described herein.

What is claimed is:

1. A projectile-shooting toy air gun, which comprises:

(a) a main housing having a barrel adapted for receiving a projectile, a handle and a trigger located thereon;

(b) a high pressure, inflatable bladder connected to said main housing, said bladder having an inlet and an outlet;

(c) a pressurizing means for providing air pressure to said bladder to inflate same, said pressurizing means being physically connected to said housing and being functionally connected to said bladder inlet;

(d) a bladder deflation valve having an upstream side and a downstream side, and being connected to said bladder outlet at said valve's upstream side, and being connected to said trigger for opening and closing thereof, and being connected to a projectile launch tube at said valve's downstream side for launching a projectile upon deflation of at least a portion of said bladder when it has been inflated, said valve having a first, closed position to maintain bladder inflation and a second, open position to effect bladder deflation; and, (e) a launch tube located in the barrel of said main housing and connected to the downstream side of said bladder deflation valve, and adapted for receiving and shooting a projectile, said launch tube further having an open firing end and at least one side of said launch tube being cut out to reduce pressure reloaded from the open firing end of said launch tube when said cut out is not encompassed by a projectile.

2. The toy air gun of claim 1 wherein said bladder deflation valve is generally in its first, closed position and is moved to its second, open position by trigger activation.

3. The toy air gun of claim 2 wherein said bladder deflation valve is connected to a spring and is spring biased to its first, closed position, and a release occurs when said trigger is activated and overcomes said spring.

4. The toy air gun of claim 1 wherein said pressurizing means is an air pump with a slider.

5. The toy air gun of claim 4 wherein said air pump has a first one way valve which permits pressurization towards said bladder and prevents pressurized air from escaping from said pump away from said bladder.

6. The toy air gun of claim 5 wherein said air pump has a second valve which is a pressure release valve which releases pressure from pumping said pump above a predetermined pressure level.

7. The toy air gun of claim 1 wherein said air pump is attached to said main housing below said barrel.

8. The toy air gun of claim 1 further including a projectile having an elongated body adapted to be inserted into said barrel and having an elongated hollow center adapted to fit over said launch tube.

9. The toy air gun of claim 8 wherein said projectile is a soft dart.

10. A projectile-shooting toy air gun which comprises:

(a) a main housing having a barrel adapted for receiving a projectile, a handle and a trigger located thereon;

(b) a high pressure, inflatable bladder connected to said main housing, said bladder having an inlet and an outlet;

(c) a pressurizing means for providing air pressure to said bladder to inflate same, said pressurizing means being physically connected to said housing and being functionally connected to said bladder inlet;

(d) a bladder deflation valve having an upstream side and a downstream side, and being connected to said bladder outlet at said valve's upstream side, and being connected to said trigger for opening and closing thereof, and being connected to a projectile launch tube at said valve's downstream side for launching a projectile upon deflation of at least a portion of said bladder when it has been inflated, said valve having a first, closed position to maintain bladder inflation and a second, open position to effect bladder deflation;

(e) a launch tube located in the barrel of said main housing and connected to the downstream side of said bladder deflation valve, and adapted for receiving and shooting a projectile; and, (f) said bladder having a predetermined expansion size to which it is capable of being inflated, and an enclosure is provided around said bladder, said enclosure being of a size less than said predetermined expansion size to enhance a controlled pressurization of said bladder during inflation and deflation.

11. The toy air gun of claim 10 wherein said bladder deflation valve is generally in its first, closed position and is moved to its second, open position by trigger activation.

12. The toy air gun of claim 11 wherein said bladder deflation valve is connected to a spring and is spring biased to its first, closed position, and a release occurs when said trigger is activated and overcomes said spring.

13. The toy air gun of claim 10 wherein said pressurizing means is an air pump with a slider.

14. The toy air gun of claim 13 wherein said air pump has a first one way valve which permits pressurization towards said bladder and prevents pressurized air from escaping from said pump away from said bladder.

15. The toy air gun of claim 14 wherein said air pump has a second valve which is a pressure release valve which releases pressure from pumping said pump above a predetermined pressure level.

16. The toy air gun of claim 10 wherein said air pump is attached to said main housing below said barrel.

17. The toy air gun of claim 10 further including a projectile having an elongated body adapted to be inserted into said barrel and having an elongated hollow center adapted to fit over said launch tube.

18. The toy air gun of claim 17 wherein said projectile is a soft dart.

19. The toy air gun of claim 10 wherein said bladder launch tube has an open firing end and at least one side of said tube cut out to reduce pressure reloaded from the open firing end of said tube when said cut out is not encompassed by a projectile.

* * * * *